US010479542B2

(12) United States Patent
Evans

(10) Patent No.: US 10,479,542 B2
(45) Date of Patent: Nov. 19, 2019

(54) BOTTLE WITH OFFSET SPOUT AND COUNTER-BALANCED BASE

(71) Applicant: Duston L. Evans, Lakewood, CO (US)

(72) Inventor: Duston L. Evans, Lakewood, CO (US)

( * ) Notice: Subject to any disclaimer, the term of this patent is extended or adjusted under 35 U.S.C. 154(b) by 0 days.

(21) Appl. No.: 15/939,017

(22) Filed: Mar. 28, 2018

(65) Prior Publication Data

US 2018/0282011 A1 Oct. 4, 2018

Related U.S. Application Data

(60) Provisional application No. 62/480,241, filed on Mar. 31, 2017.

(51) Int. Cl.
*B65D 1/40* (2006.01)
*B65D 23/00* (2006.01)
*B65D 1/02* (2006.01)

(52) U.S. Cl.
CPC ..... *B65D 1/0223* (2013.01); *B65D 23/001* (2013.01); *B65D 2501/0081* (2013.01)

(58) Field of Classification Search
CPC ..... B65D 1/0223; B65D 23/001; B65D 2501/0081
USPC ..... 220/631; 215/374, 372, 371, 379; D9/523, 526, 537, 549, 548, 455, 551, D9/668, 904, 520, 521
See application file for complete search history.

(56) References Cited

U.S. PATENT DOCUMENTS

D8,417 S 6/1875 Truax
D11,149 S 4/1879 Hood
D16,200 S 8/1885 Wadsworth
D47,355 S 5/1915 Chane
D61,415 S 8/1922 Klein
1,627,851 A * 5/1927 Kroll ..... B65D 25/2805 220/603
1,645,525 A 10/1927 Fleming
1,649,223 A * 11/1927 Grant ..... B65D 25/42 222/463
1,670,525 A 5/1928 Savery
1,688,703 A * 10/1928 Grant ..... B65D 7/04 220/631
1,802,509 A * 4/1931 Hillyard ..... B65D 7/04 222/463
1,825,670 A * 10/1931 Kuck ..... B65D 7/04 222/463
D87,255 S * 6/1932 Fuerst ..... 215/382
D95,888 S * 6/1935 Adams ..... D9/563
D101,011 S * 8/1936 Scurlock ..... D9/526
D103,426 S * 3/1937 Fuerst ..... D9/520
D112,696 S 12/1938 Havekost
(Continued)

OTHER PUBLICATIONS

U.S. Appl. No. 29/599,312, filed Mar. 31, 2018, Evans.
"Spotlight: Rocker Spirits," Littleton Report, Apr./May 2018, 2 pages.
"The Porthole Glass Infuser," 2011, Photographs retrieved from http://www.theportholeinfuser.com/, 1 page.
"Third Party Bottles," No Date Available, 6 pages.
(Continued)

*Primary Examiner* — J. Gregory Pickett
*Assistant Examiner* — Niki M Eloshway
(74) *Attorney, Agent, or Firm* — Sheridan Ross P.C.

(57) ABSTRACT

A bottle having a generally short cylindrical body, an offset spout and a flat base generally opposite the spout is disclosed. The base includes a gently curved toe portion and a heel portion opposite the toe portion. The heel portion is weighted such that if the bottle is rolled along its forward edge and released it will return to a static position sitting on the base.

21 Claims, 18 Drawing Sheets

(56) References Cited

U.S. PATENT DOCUMENTS

| | | | | | |
|---|---|---|---|---|---|
| D168,851 | S | | 2/1953 | Montenier | |
| D240,391 | S | | 7/1976 | Koenigsberg | |
| 4,096,966 | A | | 6/1978 | Korshak | |
| D255,985 | S | | 7/1980 | Seelig et al. | |
| 4,303,170 | A | | 12/1981 | Panicci | |
| 4,388,996 | A | | 6/1983 | Panicci | |
| 4,909,392 | A | * | 3/1990 | Williams | B65D 1/20 206/509 |
| D329,326 | S | | 9/1992 | Sheehy et al. | |
| D329,814 | S | * | 9/1992 | Libit | D9/526 |
| D430,796 | S | | 9/2000 | Miller | |
| 6,698,065 | B2 | | 3/2004 | Lauer | |
| 6,776,303 | B2 | | 8/2004 | Fripps | |
| D516,922 | S | * | 3/2006 | Stockwell | D9/551 |
| D546,692 | S | * | 7/2007 | Verburg | D9/526 |
| D581,288 | S | | 11/2008 | Villalobos | |
| D667,275 | S | * | 9/2012 | Seehoff | D7/317 |
| D670,169 | S | | 11/2012 | Victorino et al. | |
| 9,139,325 | B2 | | 9/2015 | Madrid et al. | |
| D756,228 | S | * | 5/2016 | Premkumar | D9/523 |
| 2008/0257845 | A1 | | 10/2008 | Rossi | |

OTHER PUBLICATIONS

"U.S. Trademark Reg. No. 4526061," May 6, 2014, 1 page.

"U.S. Trademark/Service Mark Statement of Use for U.S. Trademark Reg. No. 4526061" dated Nov. 2, 2014, 5 pages.

Morago, "Circulo Tequila invites you to take a spin," Houston Chronicle, Dec. 30, 2014, 4 pages.

"Johnnie Walker Swing 750 mL," Keg N Bottle, No Date Available, retrieved at https://kegnbottle.com/johnnie-walker-swing-750-ml, 4 pages.

"Johnnie Walker Swing Bottling Note," Master of Malt, No Date Available, retrieved at https://www.masterofmalt.com/whiskies/johnnie-walker/johnnie-walker-swing-whisky/, 10 pages.

Examination Report for European Design Application No. 004757706-0001, dated Mar. 26, 2018 2 pages.

Examination Report for European Design Application No. 004757706-0001, dated Apr. 20, 2018 2 pages.

Official Action for U.S. Appl. No. 29/599312, dated Mar. 21, 2019, 7 pages. Restriction Requirement.

Official Action for U.S. Appl. No. 29/599312, dated Aug. 19, 2019, 8 pages.

* cited by examiner

FIG. 12
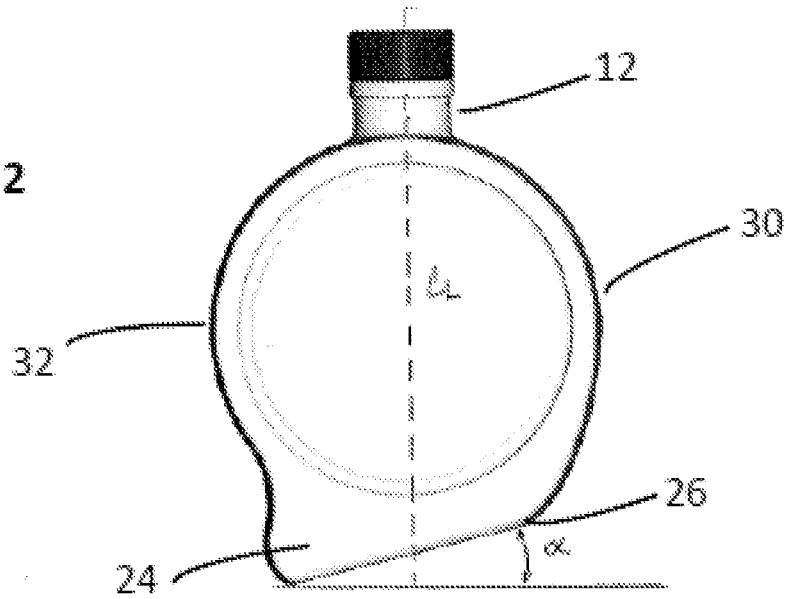
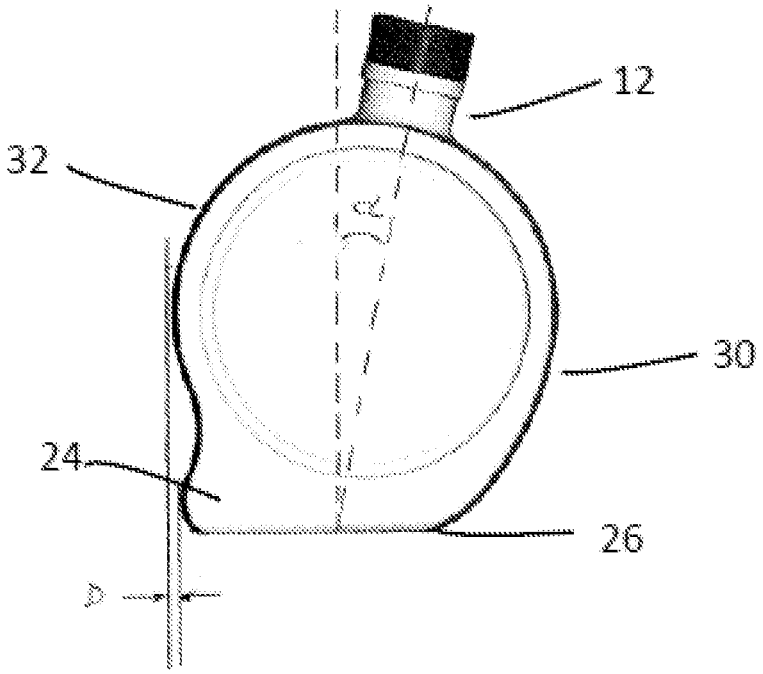
FIG. 13

BOTTLE WITH OFFSET SPOUT AND COUNTER-BALANCED BASE

CROSS-REFERENCE TO RELATED APPLICATIONS

The present application claims the benefit, under 35 U.S.C. § 119(e), of U.S. Provisional Application Ser. No. 62/480,241 filed Mar. 31, 2017 entitled "Bottle with Offset Spout and Counter-Balanced Base," the entirety of which is incorporated herein by this reference.

BACKGROUND

Bottles were developed centuries ago, with some of the earliest bottles appearing in China, Rome, and Crete. A bottle is defined as a rigid container with a neck that is smaller than the body, and a mouth or opening. Typically, but not universally, bottles are taller than wide. Bottles are often made of glass or plastic, although bottles may be made of any material that is generally impermeable to the liquid to be contained. Glass bottles are preferred in the distilled beverage industry, because glass is easily cleaned, enables long-term storage without degradation of the liquid content and inhibits seepage of external elements into the container and seepage of the liquid contents out of the container.

The design or configuration of a bottle or container can enhance or hinder its use. For example, it can be difficult to pour liquid from a bottle with a large body and short neck without spilling the liquid. This is even more difficult when the bottle is full of liquid. A bottle with a long neck may facilitate the ability to accurately pour the liquid, but if the body has a wide diameter relative to the neck, a large volume of liquid may fill the neck with a momentum that is difficult to control, making dispensing and halting the flow of the liquid more difficult. Many bottles also tend to have a height greater than the dimension of the base, making such bottles susceptible to being knocked over and the contents spilled. A glass bottle having a smooth exterior surface may be difficult to firmly grasp, particularly if the glass is wet, for example with condensation.

An example of a design that can enhance a container or fluid containing vessel is a child's self-righting training cup. Such a design is shown in U.S. Pat. Nos. 4,303,170 and 4,388,996 entitled "Self-Righting Training Cup", assigned to Kiddie Products, Inc. In these examples, a cup is provided with a hemi-spherical shaped base with a flat circular bottom surface, a cylindrical upper portion and a weight positioned proximate the flat bottom. A cover substantially closes the open end of the cup and provides a sipper opening at the end of a spout. However, to reduce the weight of the cup and make the cup lighter, it was determined that the height of the upper cylindrical portion must be limited relative to the diameter of the lower hemi-spherical portion. Cups of this type typically have a limited tipping range. In other words, if tipped too far, the cup is unable to right itself.

An adult version of the self-righting cup is disclosed in U.S. Pat. No. 4,096,966. Here, a cup is disclosed having a hemi-spherical base and a centrally located circular flat bottom portion. The diameter of the circular bottom portion small compared to the diameter of the hemi-spherical portion. As a result, when tipped and released or when set down on the hemi-spherical portion of the base, the cup will have a tendency to return to its upright position but may also have a tendency to rotate along the curved hemi-spherical base and induce an undesired oscillating motion to the cup.

Another example is U.S. published patent application 2008/0257845, entitled "Self-Righting Baby Bottle." Similar to the child-proof cups described in a preceding paragraph, the disclosed bottle has a hemi-spherical weighted base. In addition, the cap that encloses the open neck of the bottle includes a nipple that prevents significant spilling of the liquid contents if the bottle is significantly tipped, for example, beyond ninety degrees. The bottle is provided with a weighted end piece that does not include a flat bottom portion. As a result, when tipped and released the bottle will oscillate and the cap will move in a circular or elliptical path back and forth past the vertical position until the liquid in the bottle settles and the motion of the bottle dampens.

U.S. Pat. No. 6,776,303, entitled "Self-Righting Fluid-Storage Container," is designed for athletes to use during training or competition without the need to be concerned about setting down the container. Rather, the design permits the athlete simply to drop or throw the container after use. Here, the design includes a long cylindrical container and an oversized weighted base. The base is elliptical in cross section to impart a purposeful rotation and oscillation of the container when released which gradually dampens the motion and moves the orientation of the container towards a desired vertical orientation. A straw and cap prevent excess spilling.

U.S. Pat. No. 9,139,325, entitled "Self-Righting Container," is directed to a fluid container having an elongate tapered neck, a circular flange at the end of the neck and a weighted hemi-spherical base with a centrally located flat portion. As noted above, given the elongate neck and the oversized diameter of the hemi-spherical base, once the container is tipped and the fluid content moves to the open end of the neck, the momentum of the moving fluid is difficult to counteract without a significant counterbalancing weight. The hemi-spherical base will also impart a rotational and oscillating motion to the container upon release.

The foregoing references are incorporated herein by reference in their entirety and are hereby made a part of this specification. To the extent publications and patents or patent applications incorporated by reference contradict the disclosure contained in the specification, the specification is intended to supersede and/or take precedence over any such contradictory material.

SUMMARY

According to aspects of the present disclosure, a bottle with a curved outer surface and counter-balanced base is disclosed. In one embodiment, the bottle includes a first side and a second side, each of the sides being generally circular in shape. A wall or front and rear surface connects the first side and the second side. The wall is curved and sufficiently wide to allow the bottle to roll on at least a leading or front portion of the wall. In one embodiment, a spout extends from the top of the bottle and is offset relative to a vertical centerline of the bottle. In other embodiments, the spout need not be offset. The base has a heel portion that provides stability when the bottle is at rest on the base and a counterbalance relative to rolling of the bottle along its front edge or wall. The counterbalance or counterweight is offset relative to the centerline of the bottle. Stated differently, it is not coaxially aligned with the centerline of the bottle when the bottle is resting on its base. As such, the bottle may be rolled along a surface on its front edge or wall, for example by pushing the spout, and the bottle is enabled without additional assistance to return to a level or stable setting on its base by rocking back in the opposite direction under the influence of the heel portion. Thus, the bottle may be tipped or rolled along its edge to reposition the spout for purposes of pouring liquid from the bottle out of the spout and when released, the bottle will automatically return to its upright position on its base due to the off-set or eccentrically weighted base.

According to aspects of the present disclosure, one embodiment comprises a bottle having a body with a first side and a second side, the second side space from and parallel to the first side, each of the first and second sides being generally circular in shape. An edge connects the first side and the second side, and the edge has a leading portion and a trailing portion. A spout extends from the edge, the spout offset from the vertical centerline of the body. The bottle has a substantially flat base, the base having a toe portion adjoining the leading portion of the edge and a heel portion spaced from the toe portion and adjoining the trailing portion of the edge. In addition, when the bottle is supported on a generally flat horizontal surface by the leading portion of the edge, the bottle will roll to a position resting on the base under the influence of the heel portion.

According to aspects of the present disclosure, in a second embodiment, a container for holding liquids is provided and includes a body having a generally circular first side and a generally circular second side spaced from the first side. A curved surface interconnects at least a portion of the first and second sides. A spout extends outwardly from the curved surface. A flat base is located generally opposite the spout between the first and second sides, and the base has a toe portion and a heel portion. The bottle is adapted to roll on the curved surface when the spout is moved from a first upright position to a second position such that liquid may pour from the spout. The bottle is also adapted to return to the first position, e.g., a static position resting on the base, solely under a force applied by the heel portion. And when the bottle moves between the first and second positions, the bottle generally remains in a single vertical plane.

According to aspects of the present disclosure, a third embodiment of a bottle comprises a first side wall and a second side wall spaced from the first side wall; a flat base interconnecting a portion of the first side wall and second side wall, the base having a toe portion and a heel portion spaced from the toe portion; an edge surface interconnecting the first side wall and the second side wall and extending from the toe portion to the heel portion of the base; a spout extending outwardly from the edge surface; and wherein, the bottle has a vertical centerline extending between the base and the spout and the heel portion are offset from the centerline.

It is noted that as used herein, the terms "includes" and "including" mean, but is not limited to, "includes" or "including" and "includes at least" or "including at least." The term "based on" means "based on" and "based at least in part on." In addition, it should be noted that the examples described herein are provided for purposes of illustration, and are not intended to be limiting. Other devices and/or device configurations are also contemplated.

In other embodiments the bottle may include a channel in the first side and/or the second side proximate the edge. The first side and the second side may include an inner portion and an outer portion, and wherein the inner portion is inset relative to the outer portion. The inner portion may have a circular shape or a non-circular shape. The channel may have a substantially C-shaped cross-sectional shape, a U-shaped cross-sectional shape or a different cross-sectional shape, such as square, triangular or other geometry. The toe portion of the base may comprises a non-linear edge.

The Summary is neither intended nor should it be construed as being representative of the full extent and scope of the present invention. Moreover, reference made herein to aspects of the present disclosure should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

FIG. 12 is a left-side view of a bottle according to aspects of this disclosure, with the bottle oriented such that the neck is aligned with the vertical centerline of the bottle.

FIG. 13 is a left-side view of the bottle of FIG. 12, with the bottle oriented at rest on its base.

Figure 1:
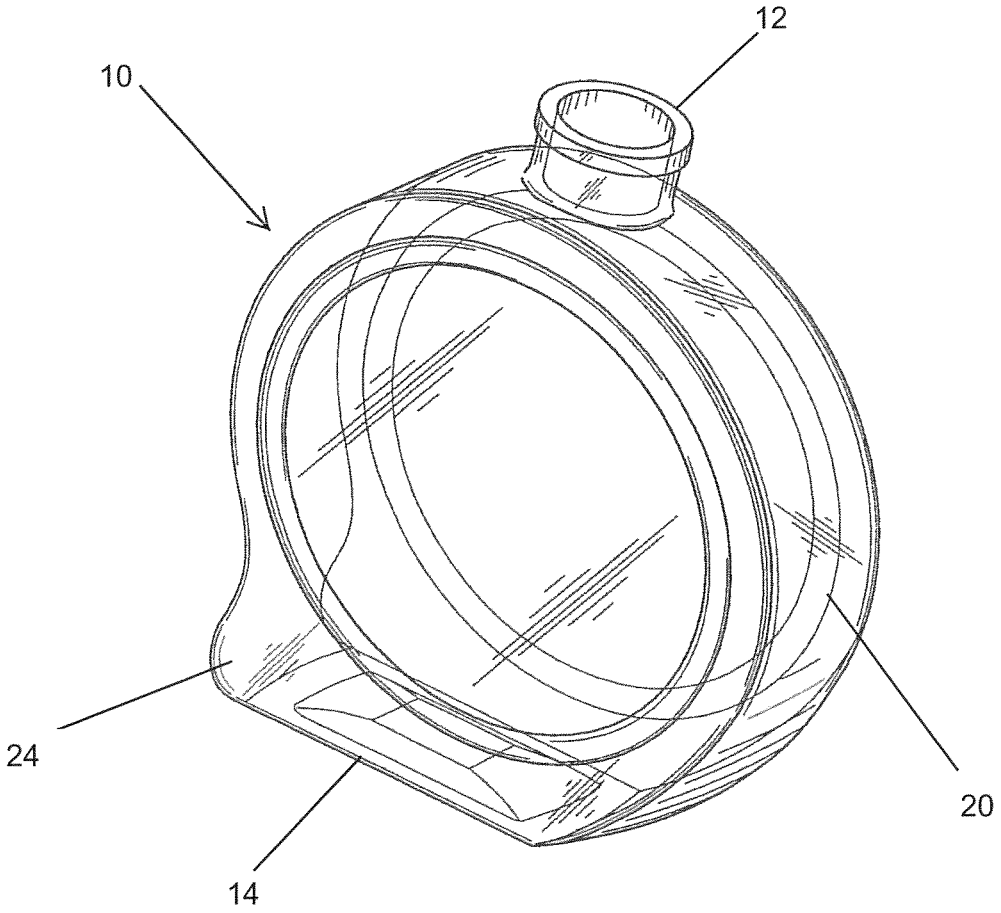
FIG. 1 is a top perspective view of a first embodiment of a bottle with offset spout and counter-balanced base.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIGS. 1-10 illustrate one example of a bottle according to aspects of the present disclosure. In this embodiment, the bottle is transparent, although the bottle may be, translucent or semi or fully opaque. As shown, the bottle 10 has a spout 12 off-set relative to the centerline of the bottle, and a substantially flat base 14. The bottle includes a first side 16 and a second side 18, each of the sides being generally circular in shape. A curved wall or edge 20 extends between and connects the first side 16 and the second side 18. An inset or recessed portion 22 is formed in the base 14. The shape and size of the recess may vary, or the recess may be omitted completely. The recess 22 reduces the amount of material used in the bottle, thereby lowering the cost and weight of the bottle. It should also be appreciated that the neck or spout 12 may be longer or may have a different cross-sectional shape. For example, the cross-sectional shape may be square, oval, triangular or any other geometric shape, or symmetrical or asymmetrical. The spout 12 may be enclosed with any type of sealing member, including but not limited to a cork, a metal cap, or a screw on lid. The base 14 includes a heel portion 24 and a toe portion 26. Putting aside the spout 12 and base 14, the body of the bottle 10 is analogous to a short cylinder with the first and second sides 16 and 18 comprising the ends of a cylinder and the outer surface or edge 20 forming the curved side wall of the cylinder. Other generally analogous shapes are a thick disk or a solid wheel.

Figure 3:
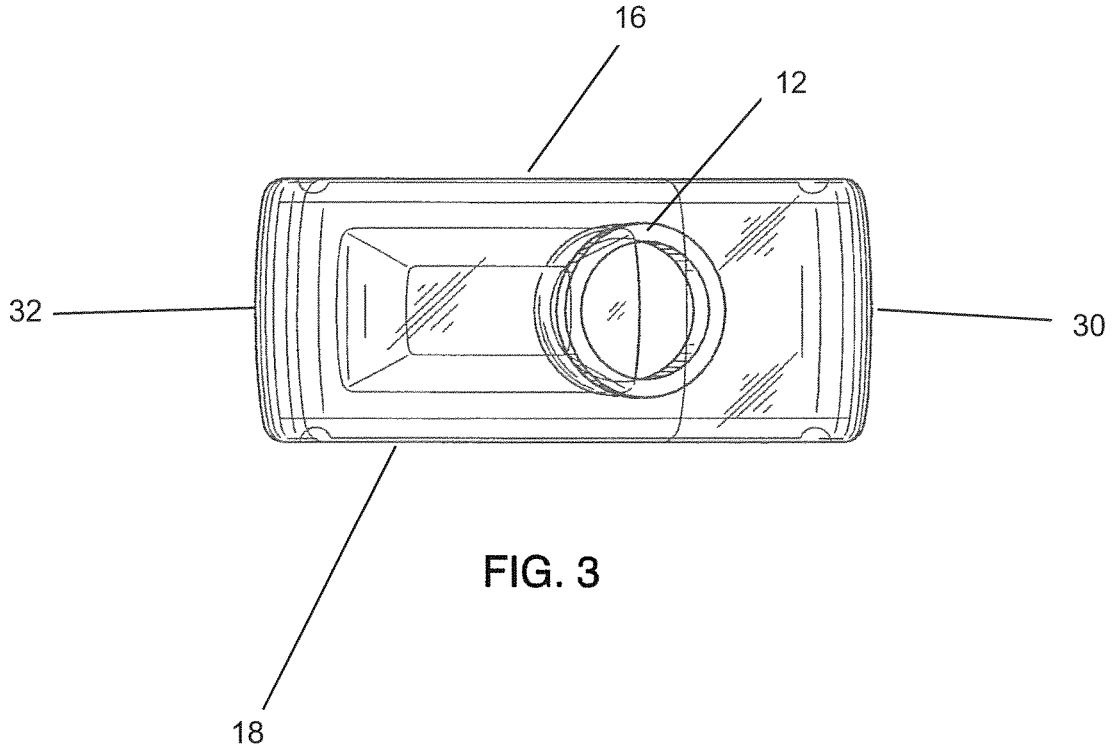
FIG. 3 is a top view of the bottle corresponding to FIG. 1.
Figure 4:
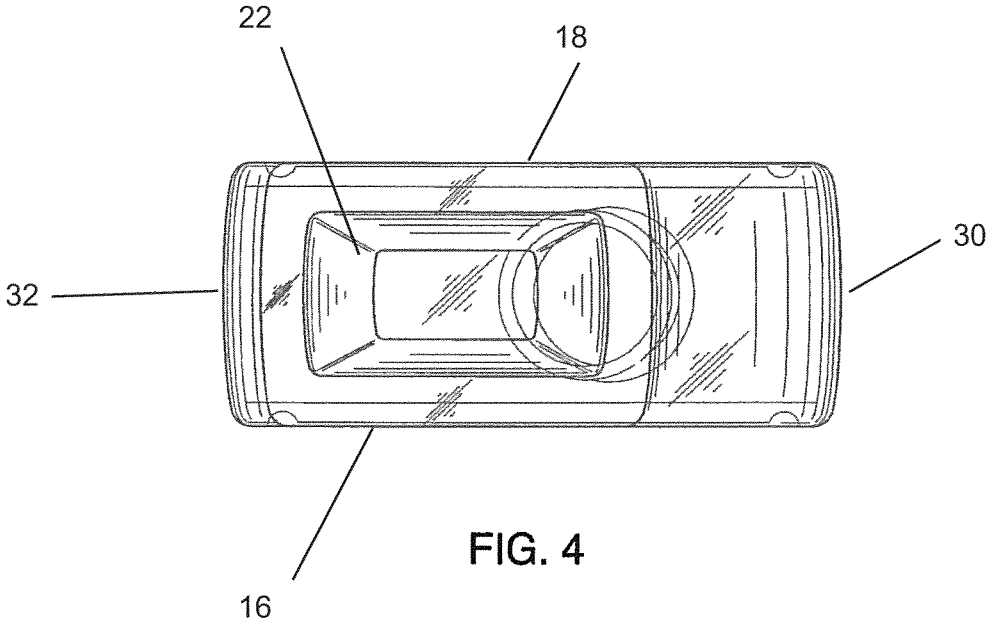
FIG. 4 is a bottom view of the bottle corresponding to FIG. 1.
Figure 5:
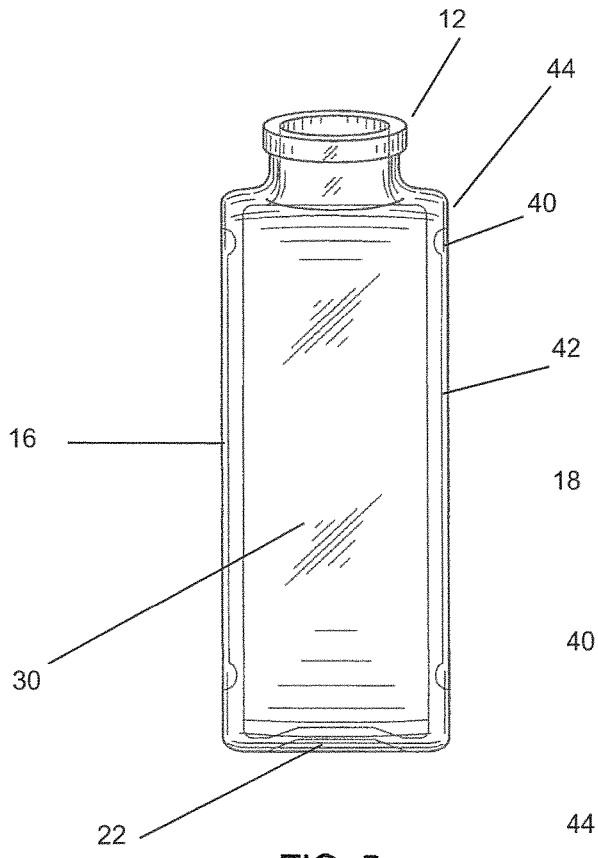
FIG. 5 is a front view of the bottle corresponding to FIG. 1.
Figure 6:
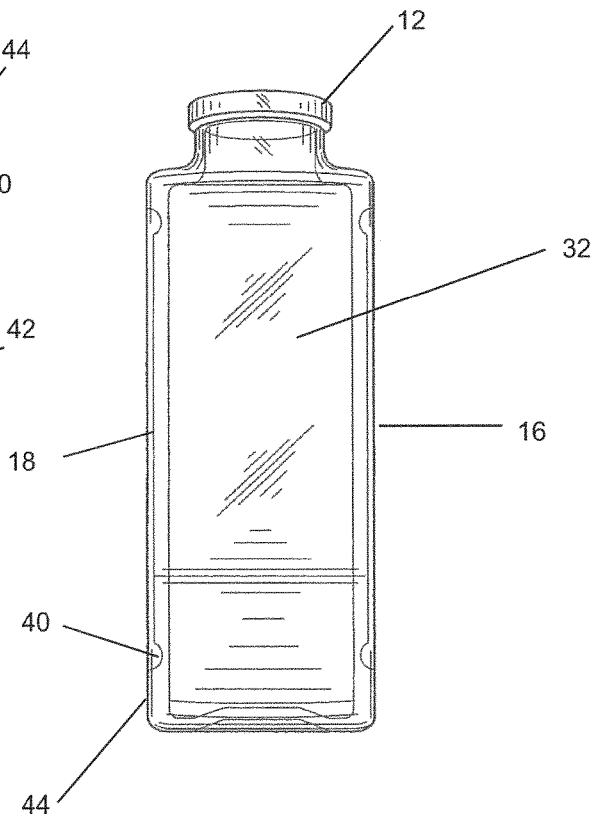
FIG. 6 is a back view of the bottle corresponding to FIG. 1.
Figure 7:
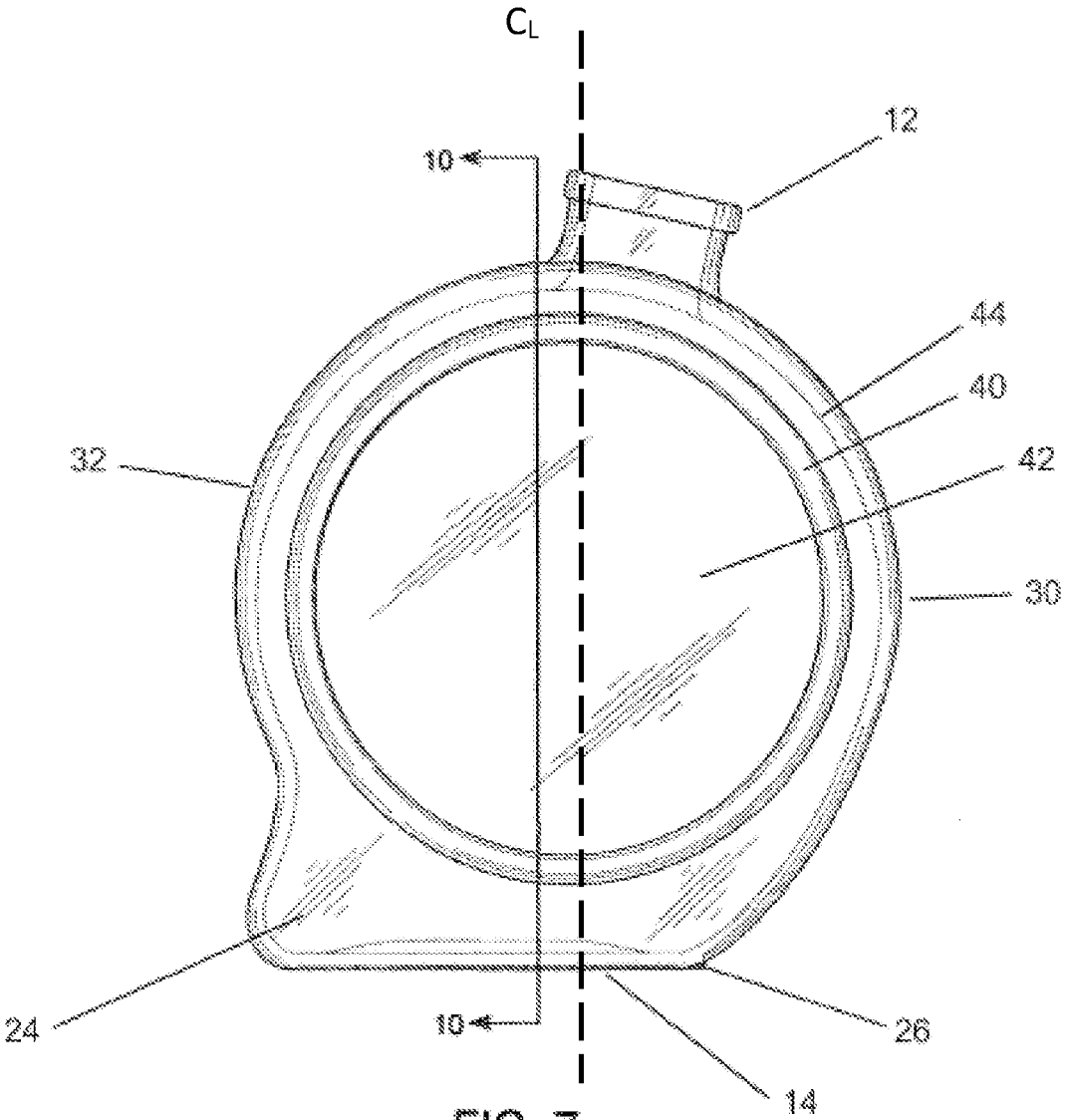
FIG. 7 is a left-side view of the bottle corresponding to FIG. 1.

With reference to FIG. 3, the wall or edge 20 to the right of the spout is the front or leading edge 30 of the bottle. The wall 20 to the left of the spout 12 in FIG. 3 is the trailing or back edge 32 of the bottle 10. The front edge 30 extends between the spout 12 and the toe portion 26 of the base 14. The back edge 32 extends from the spout 12 to the heel portion 24. With reference to FIG. 7, the heel portion 24 is offset from the vertical centerline of the bottle and is spaced farther from the vertical centerline of the bottle 10 compared to the toe portion 24. In addition, a majority of the base 14 is positioned off-center relative to the centerline. The location, size and mass of the heel portion 24 provides stability to the bottle when the bottle is at rest on the base 14. In addition, according to aspects of the present disclosure, the heel portion also is a counterweight for purposes of returning the bottle to an upright position on its base 14 following the bottle 10 rolling forward along the front surface 30. More particularly, the bottle 10 is intended to roll forward along the front edge 30 to pour the liquid content out of the spout without lifting this bottle. As the bottle is rolled off its base 14 such that the bottle 10 is resting on the front edge 30, e.g., for purposes of dispensing liquid through the spout 12 without lifting the bottle, the counterweight or heel portion 24 is configured to provide a counterbalance to the bottle. If the bottle is released, the counterbalance provided by the heel portion 24 prevents the bottle from continuing to roll forward and it also causes the bottle to return to a level setting on its flat base 14 without additional input, e.g., without assistance, by rolling back to a starting position on its base 14 after dispensing liquid from the bottle. During the rotational movement of the bottle—forward then backward, the bottle remains in a single plane. The bottle 10 also will return to its base if it is placed on its front surface 30, e.g., after being used. Releasing the bottle will cause the bottle to return to a position resting on the base 14.

Figure 2:
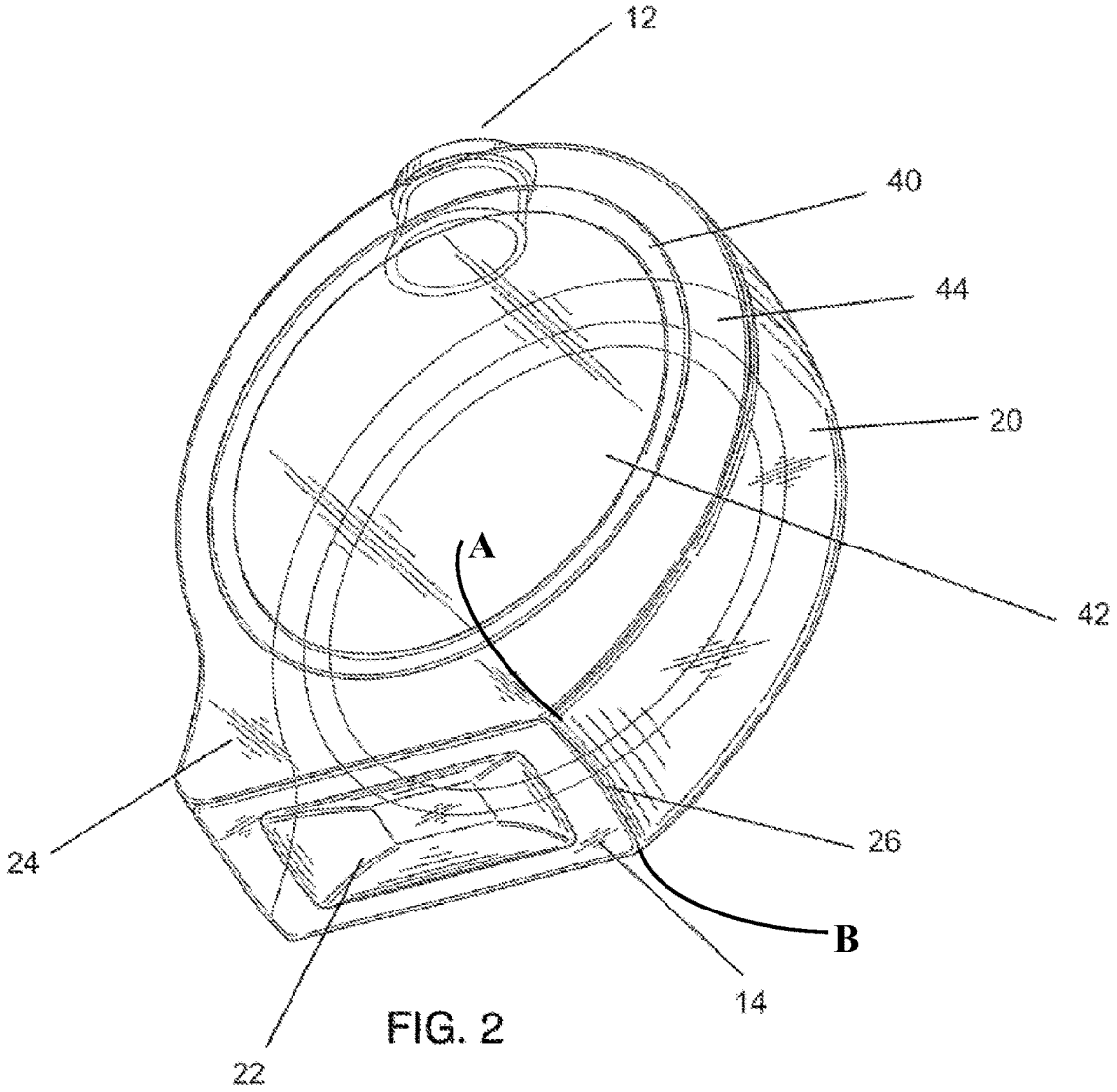
FIG. 2 is a bottom perspective view of the bottle corresponding to FIG. 1.

For optimized performance, in a preferred embodiment, the toe portion 26 is not a straight line or sharp edge but is a curved or rounded edge between the first side 16 and the second side 18 to provide a lesser but sustained resistance during transition of the bottle from the base 14 to the front surface 30 rather than a greater more instantaneous resistance and, upon return, from the front surface 30 to setting on the base 14. This modest curve is shown in FIG. 2 between points A and B. By having a slightly arched, crowned or curved profile rather than a linear profile, less force is needed to overcome the resistance to rolling presented by the toe portion 26 and, similarly, less force is required to overcome the resistance of the toe portion 26 when the bottle returns to its position resting on its base 14 following rolling forward.

As would be appreciated by a person of skill in the art upon reading the present disclosure, the weight of the heel portion 24, its distance from the toe portion 26 (which is the pivot point or fulcrum for the transition between the bottle statically resting on its base 14 and rolling on the leading edge 30), the weight of the bottle 10 and the weight of the liquid in the bottle are all factors in the optimization of the motion that returns the bottle to its static sitting position. It also should be appreciated that the size and configuration of the recess 22 also relates to the size and weight of the heel portion 24 needed to prevent continuing rotation of the bottle 10 and to return the bottle 10 to its upright position when the bottle is released. For example, a larger recess 22 generally allows for a smaller the heel portion 24.

Figure 9:
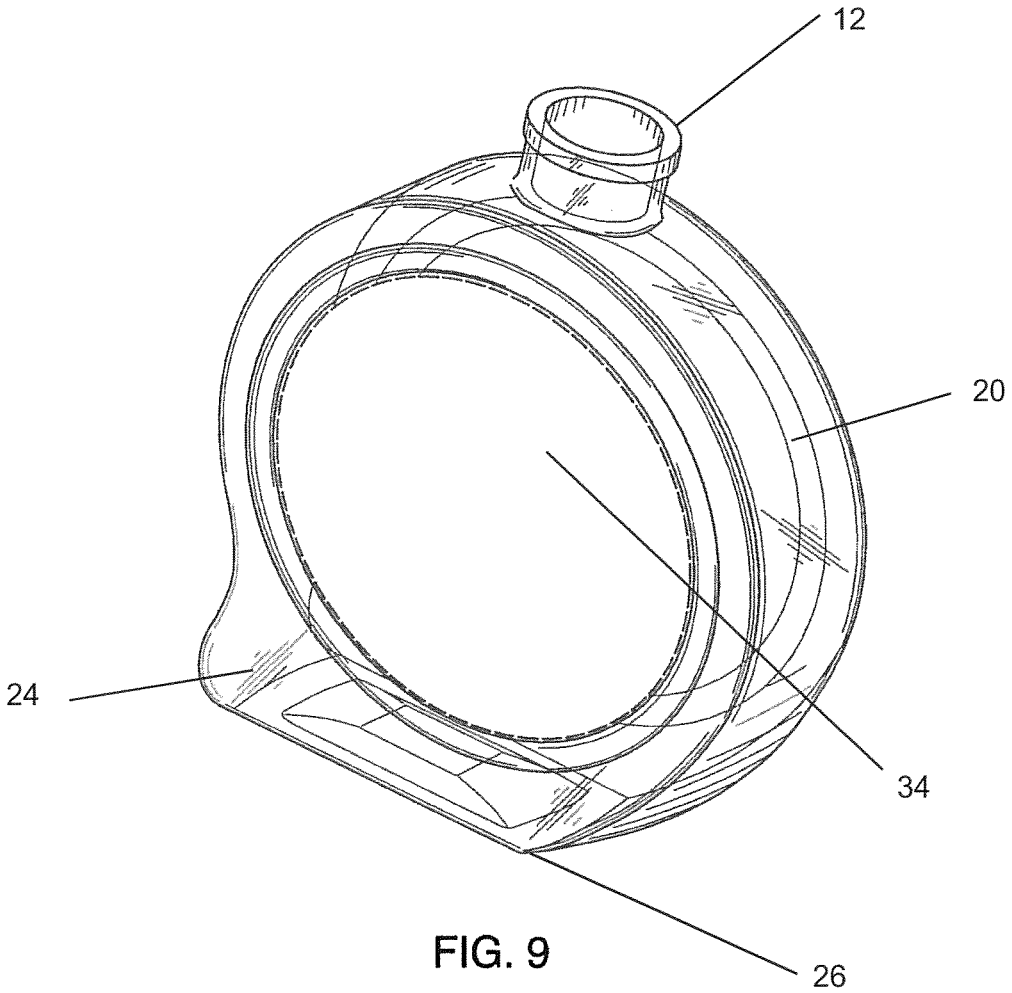
FIG. 9 is a top perspective view of the bottle corresponding to FIG. 1 showing an example label as it may appear on one or both sides of the bottle, wherein the label is shown in dashed lines.
Figure 10:
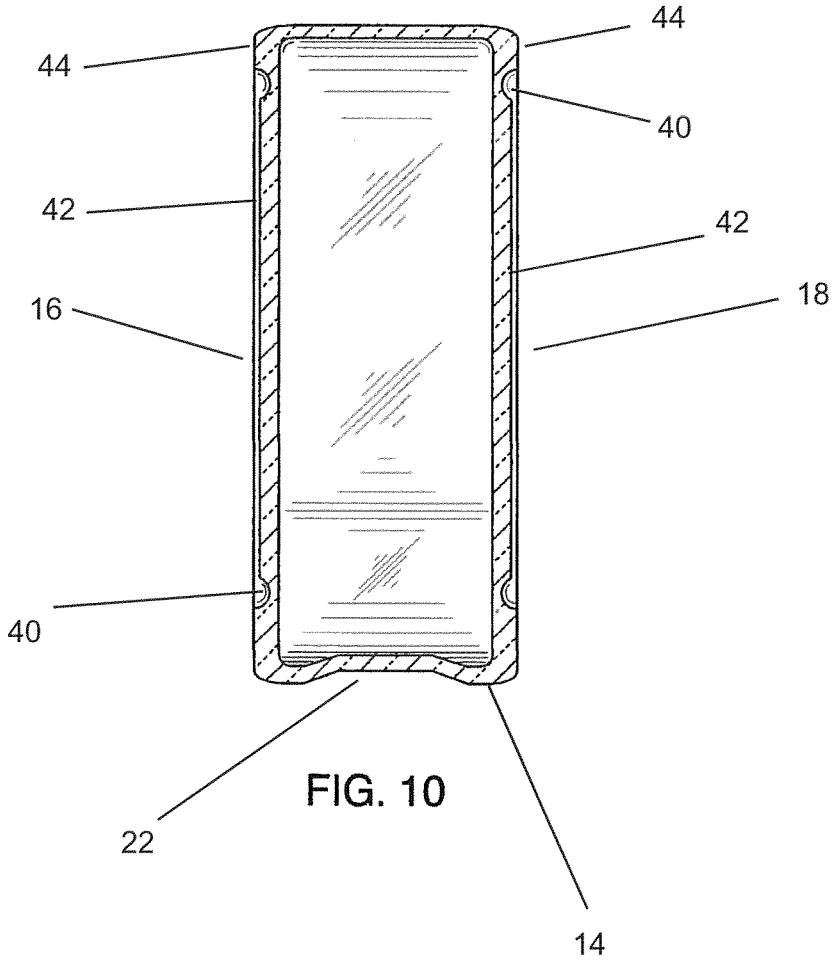
FIG. 10 is a cross-section view of the bottle taken along lines 10-10 in FIG. 7.

FIGS. 7, 9 and 10 illustrate additional structural features of the embodiment of the bottle 10. For example, according to aspects of the present disclosure, one embodiment of bottle 10 has a substantially U-shaped channel or concave groove 40 around each of the first side 16 and the second side 18. The groove 40 surrounds and defines an inner portion 42 of the first side 16 and the second side 18. The inner portion 42 is recessed or inset relative to an outer rim 44 of the first side 16 and the second side 18. An outer circular ring or rim 44 interconnects with the edge 20. The substantially U-shaped channel 40 is also seen between the inner portion 42 and the outer rim 44 of the first side 16 and the second side 18 in FIGS. 5 and 6. While the channel 40 is illustrated proximate the edge surface 20, it may be located radially inwardly from this position, giving the rim 44 a wider radial dimension and, in addition, more than one channel 40 may be incorporated into the sides 16 and 18. The groove 40 provides not only an aesthetic design detail, but a contoured surface to facilitate holding the bottle, particularly when the bottle or a person's hand may be wet. It should be appreciated that the groove 40 may comprise a number of different cross-sectional shapes, providing different aesthetics and differently shaped holding or gripping surfaces, including semi-circular, semi-oval, and square shaped, to name a few. It should be appreciated that the groove 40 may be any other shape geometric shape, including a multi-sided polygon.

Figure 8:
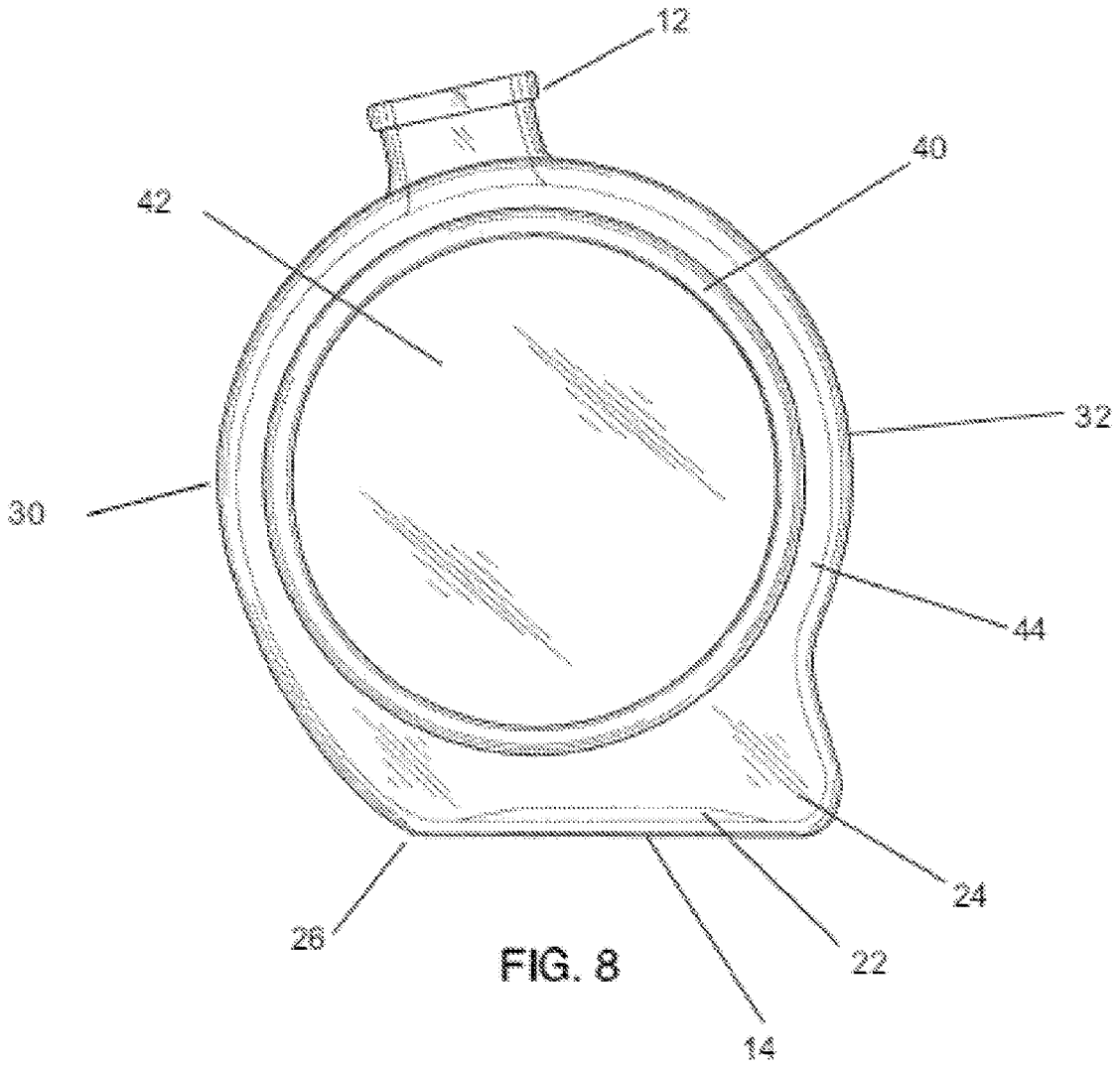
FIG. 8 is a right-side view of the bottle corresponding to FIG. 1.

As illustrated in FIG. 8, a label 34 may be positioned in the inner portion 42 for marketing purposes. Specifically, the label may include branding, manufacturing and information about the product within the bottle. Of course, a label 34 is not required.

As discussed above, the bottle 10 is preferably weighted such that it automatically returns to a substantially upright position, e.g., resting on the bottom surface. According to aspects of the present disclosure, the counterweighted portion 24 is configured to cause the bottle 10 to return to its upright position, on its base 14, when supported on its front side 30 and released. FIGS. 11A-11D illustrate a sequence of four images of the bottle 10 automatically returning to an upright position after being released from a tilted position on a substantially flat surface. The counterbalanced portion 24 may have a different shape than as illustrated, and still return the bottle 10 to its upright position. Preferably, the counterweighted portion 24 will return the bottle to its upright position whether the bottle is full of liquid, partially full or empty.

Figure 11B:
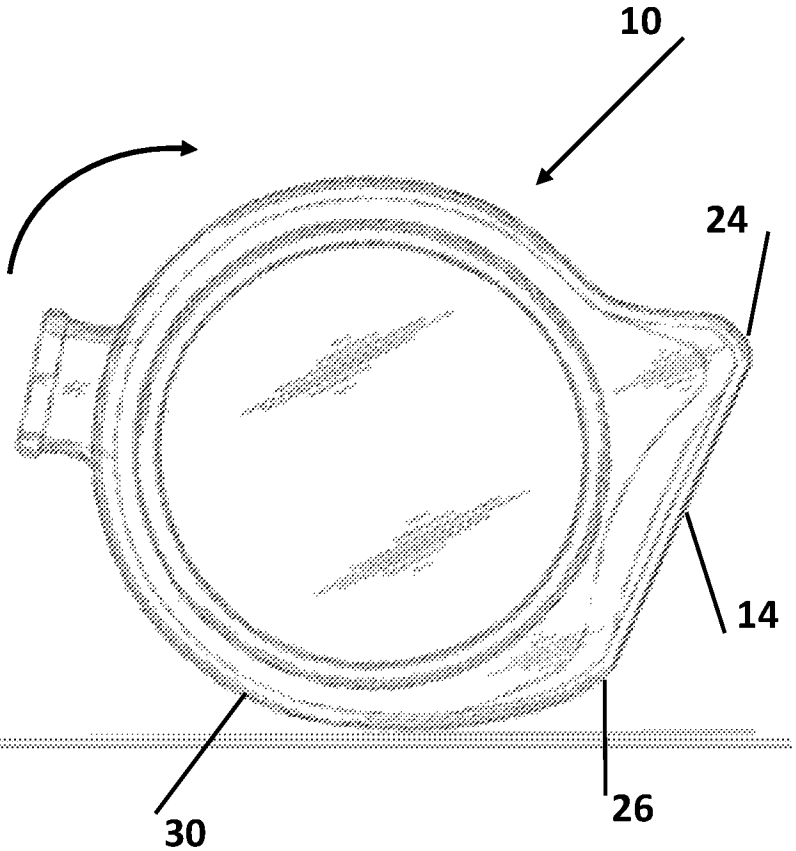
FIGS. 11A-11D are a series of photographs that sequentially illustrate the bottle corresponding to FIG. 1 automatically returning to an upright position from a standing position where the spout is capable of dispensing liquid content from the bottle.
Figure 11A:
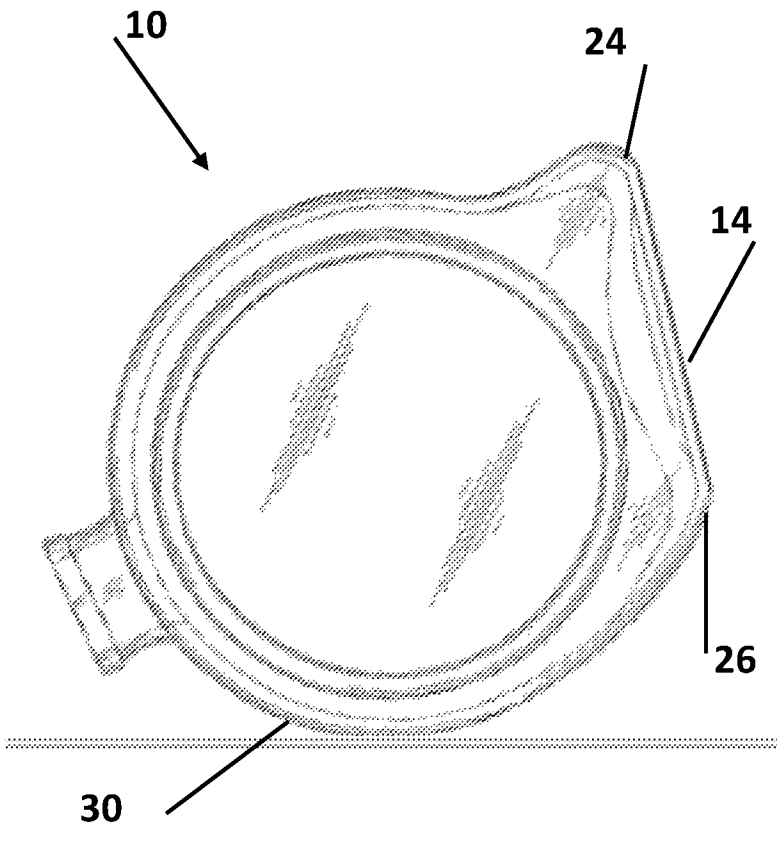
Figure 11D:
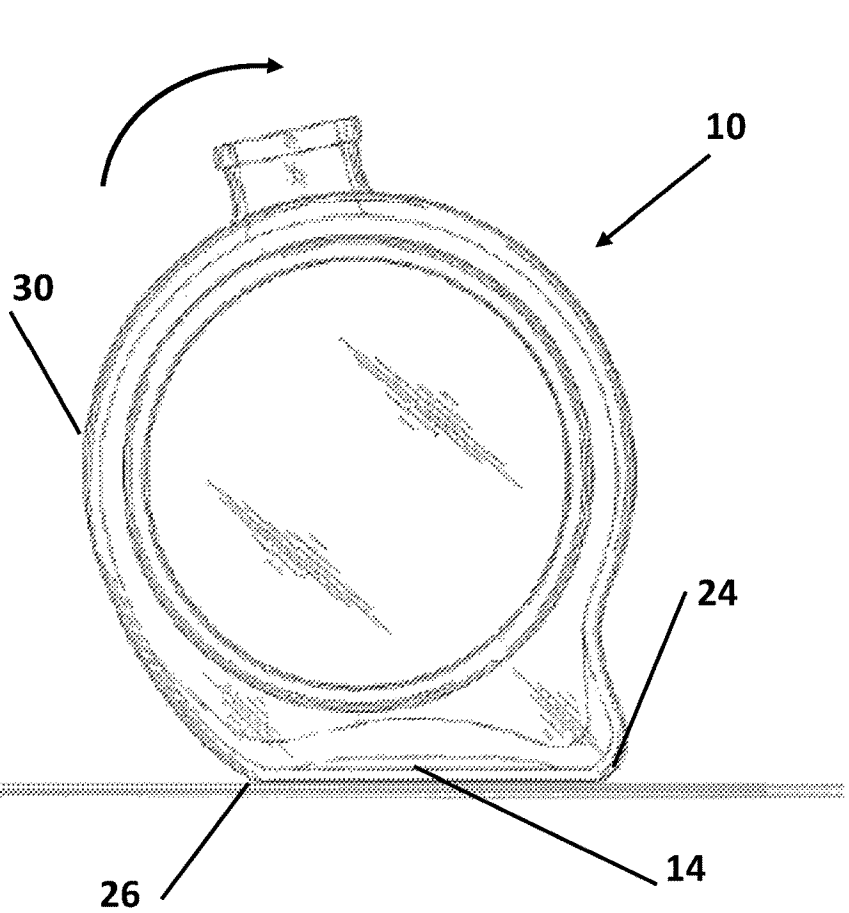
Figure 11C:
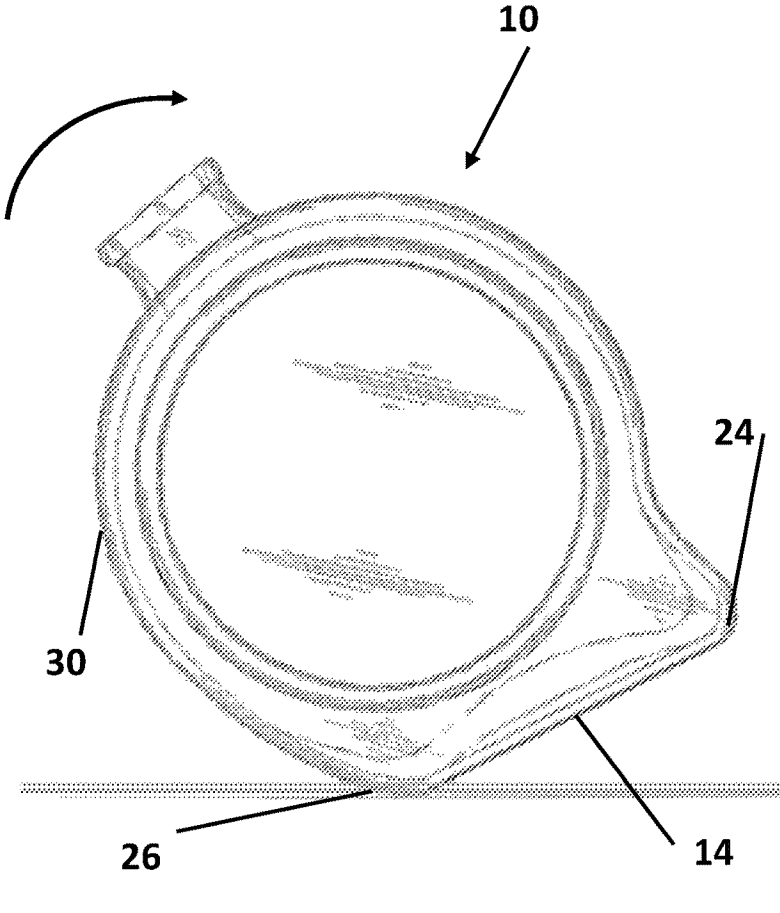
Figure 14:
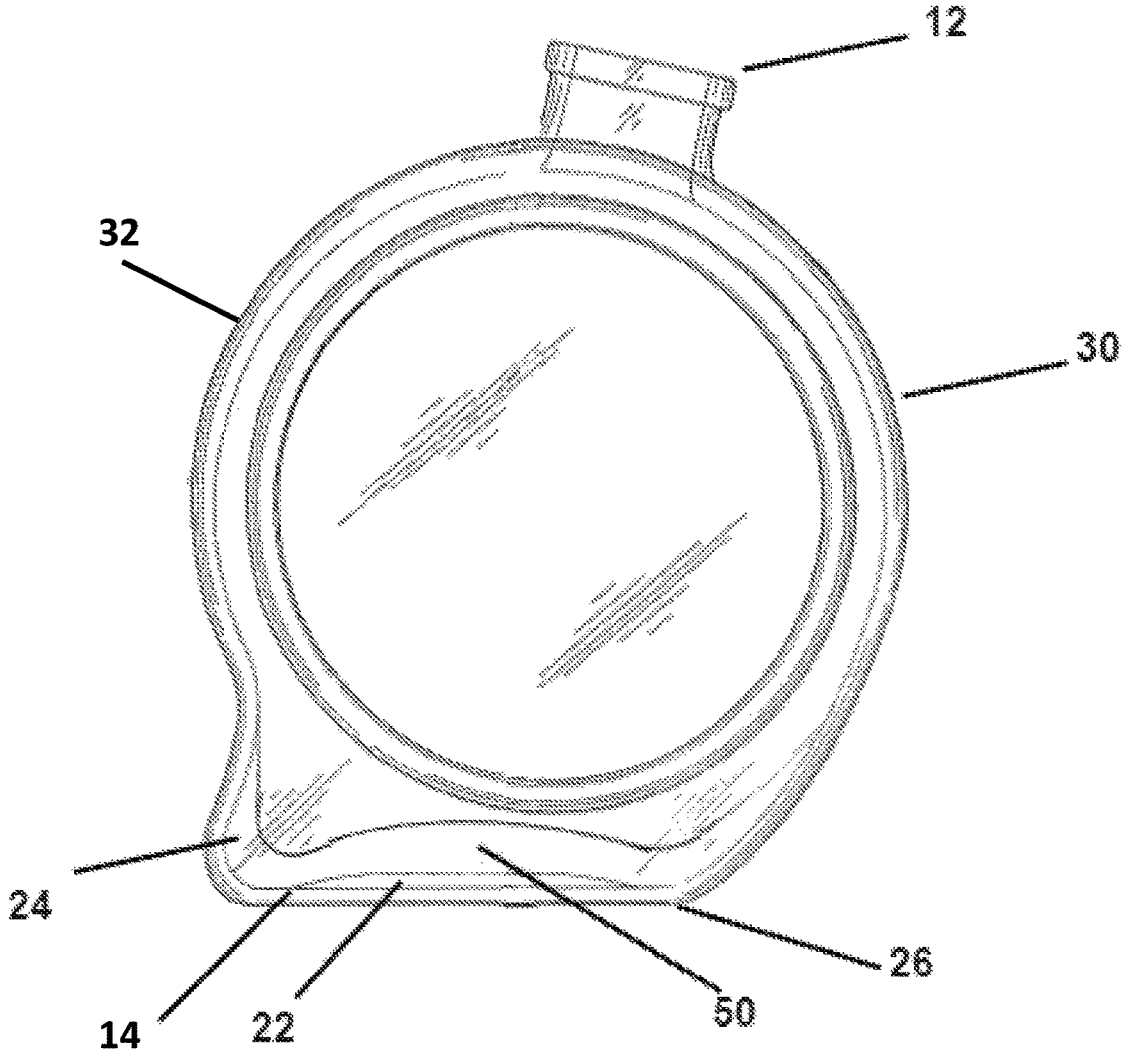
FIG. 14 is a left side view of a second embodiment of a bottle according to aspects of the present disclosure.
Figure 15:
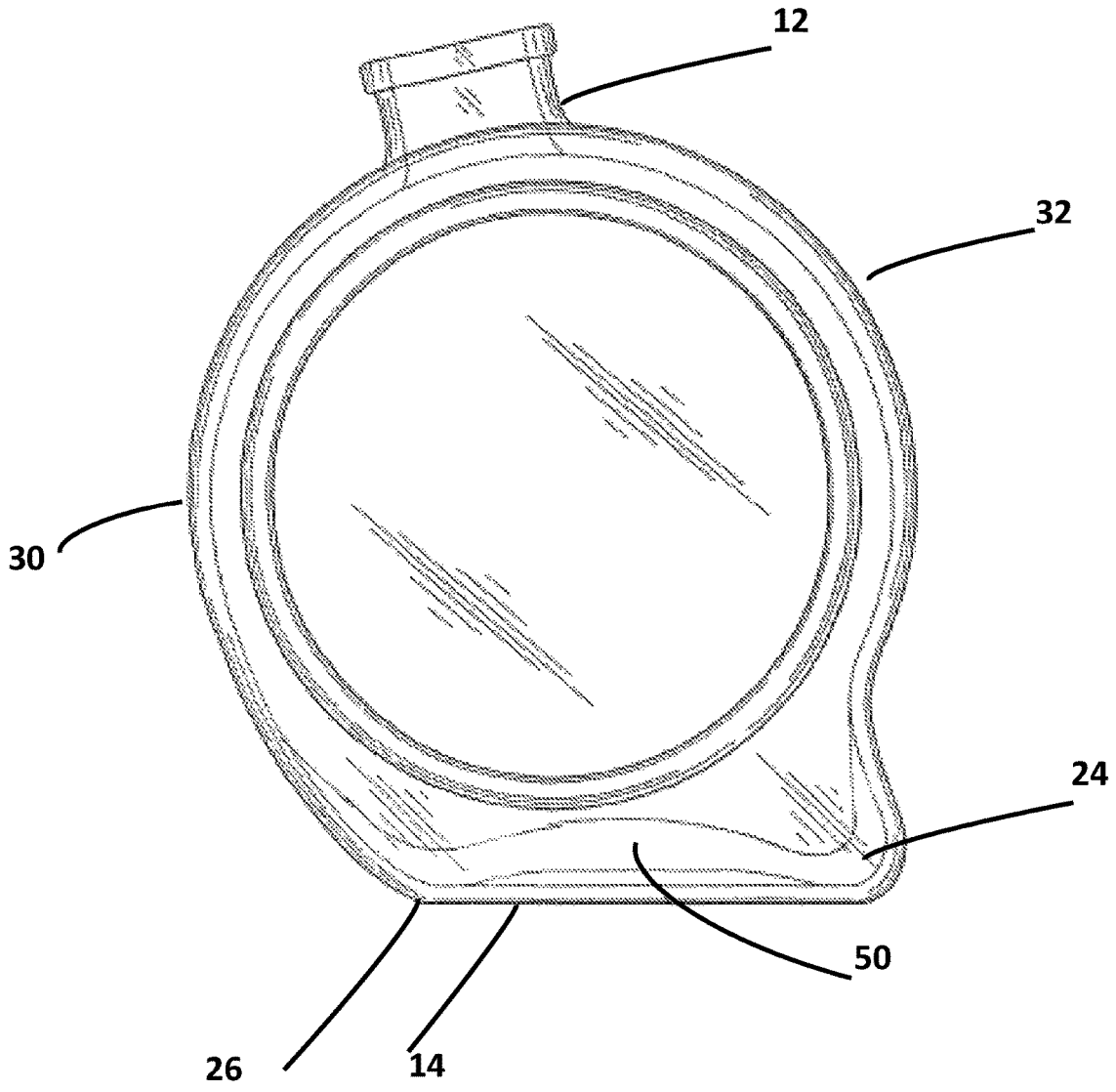
FIG. 15 is a right side view of a bottle corresponding to FIG. 14.
Figure 16:
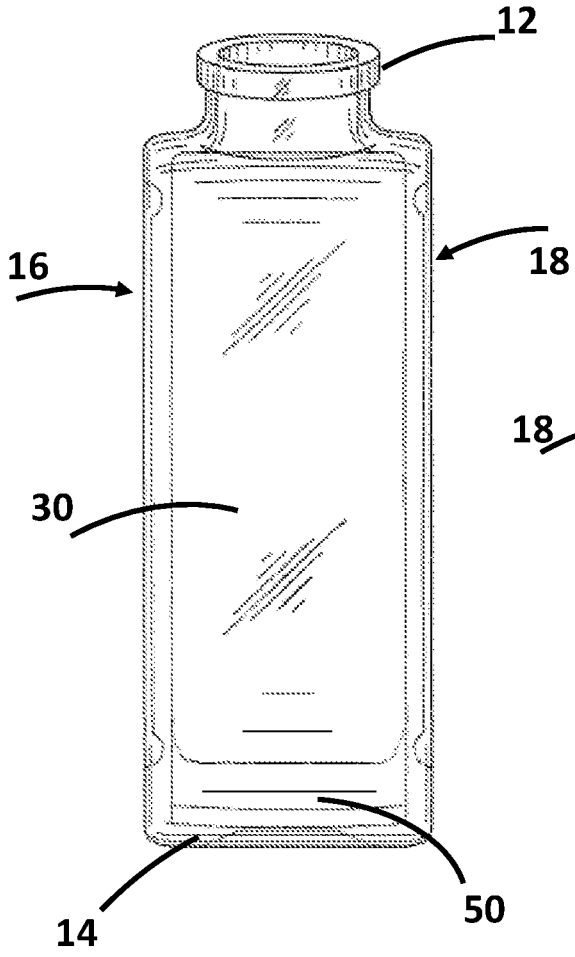
FIG. 16 is a front view of a bottle corresponding to FIG. 14.
Figure 17:
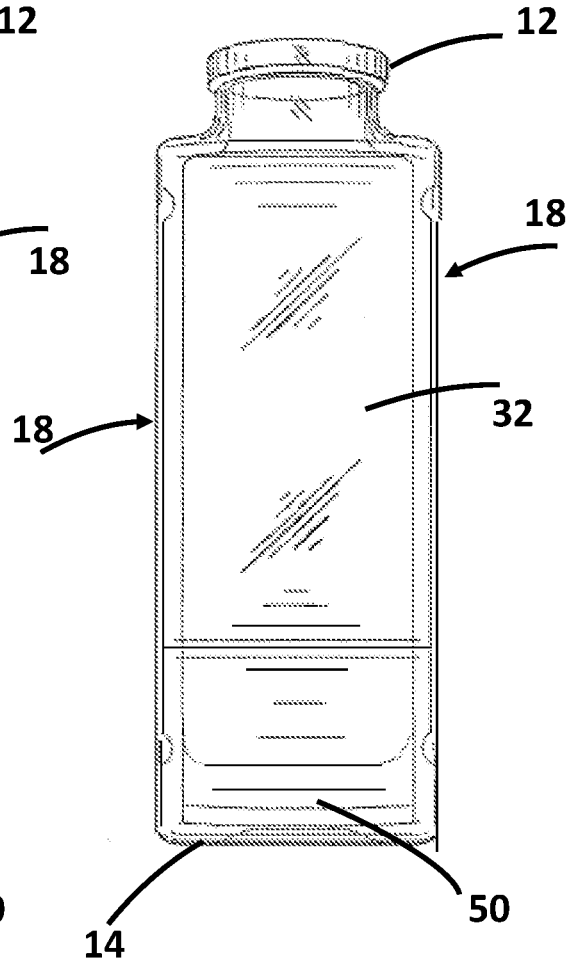
FIG. 17 is a back view of a bottle corresponding to FIG. 14.

FIG. 11A shows the bottle 10 with the spout 12 positioned at a downward angle, for example, for purposes of pouring the contents into another vessel, such as a glass. A force F must be applied to the bottle 10 to overcome resistance from the toe portion 26 and the counterweight 24 to orient the bottle 10 in this position. In FIG. 11B, the force F is removed. As a result, the counterweight provided by the heel portion 24 causes the bottle 10 to rotate clockwise (relative to the orientation of FIG. 11). The bottle has rolled backward and the spout 12 has moved upward as the bottle 10 rolls clockwise. In FIG. 11C, the bottle as rotated to the transition point where the toe portion 26 is resisting further clockwise rotation. At this point, the weight and location of the heel portion 24 is sufficient to cause the bottle 10 to roll past the toe portion 26 and come to rest on the base 14. The bottle is resting on the base 14 in FIG. 11D. The heel portion 24 prevents the bottle from continuing to roll clockwise onto the back edge 32. The path of the spout 12 remains in the same vertical plane when the bottle is rolled forward and backward.

FIGS. 12 and 13 illustrate the off-set of the spout 12 relative to the vertical centerline of the bottle 10 by an angle alpha ($\alpha$). In one embodiment, this angle is between 13 and 15 degrees. Different angles may be used. As also seen, the heel portion is recessed by a distance "D" relative to the outer perimeter of the back edge 32. The farther the heel portion 24 is from the toe portion 26, the less weight is needed in the heel portion 24, assuming all other factors remain constant. Conversely, the closer the heel portion 24 is to the toe portion, the greater the weight of the heel portion must be to return the bottle to the upright position.

FIGS. 14-17 illustrate a second embodiment of a bottle according to aspects of the present disclosure. Here, the bottle includes a "push" 50 as part of the base 14. The push 50 adds weight to the bottom of the bottle 10, making the bottle 10 more stable when at rest on the base 14. A push 50 can also reduce the volume of liquid in the bottle or alter the location of the center of gravity of the bottle.

Figure 18:
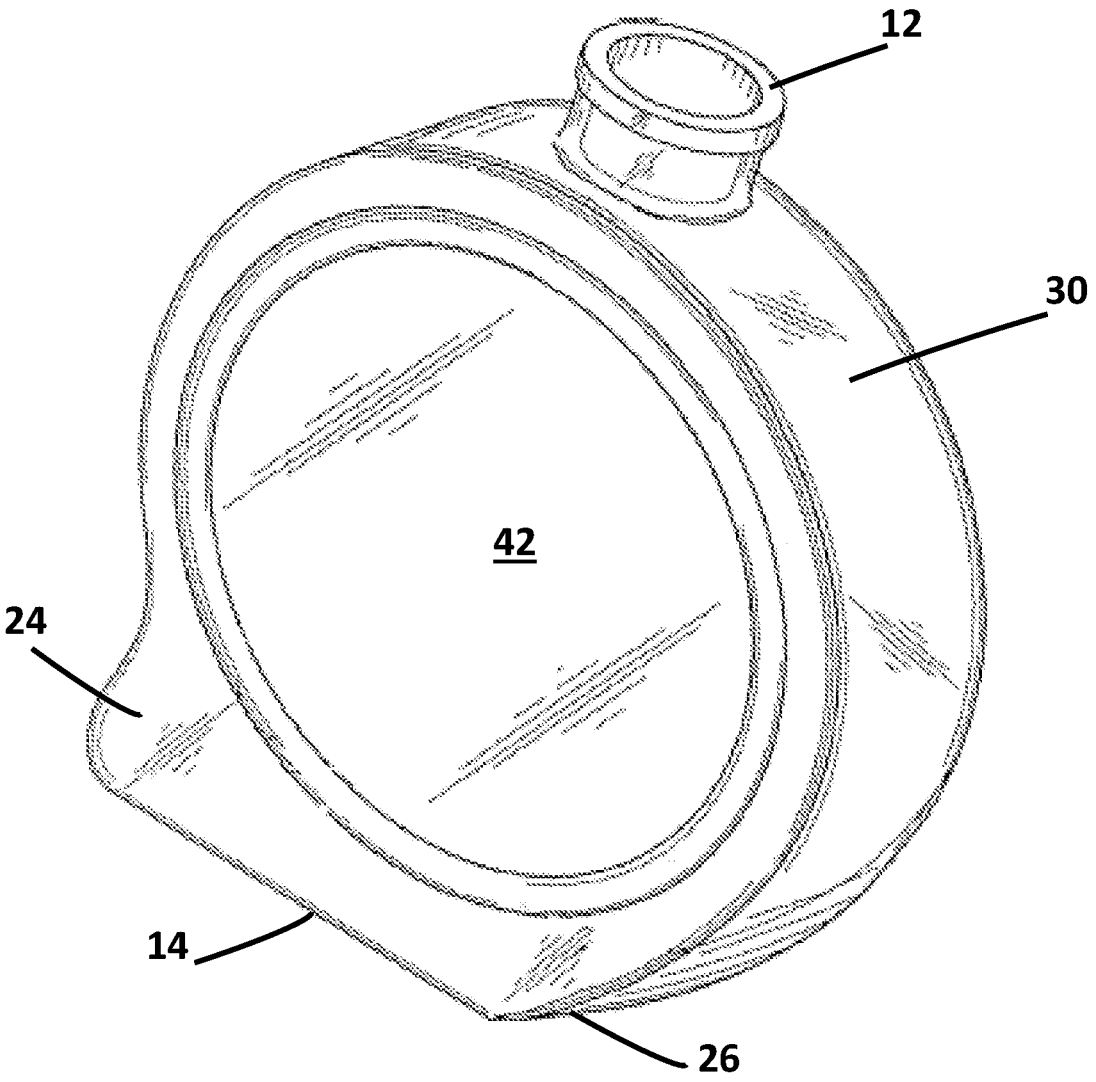
FIG. 18 is a perspective view of a third embodiment of a bottle according to aspects of the present disclosure.
Figure 19:
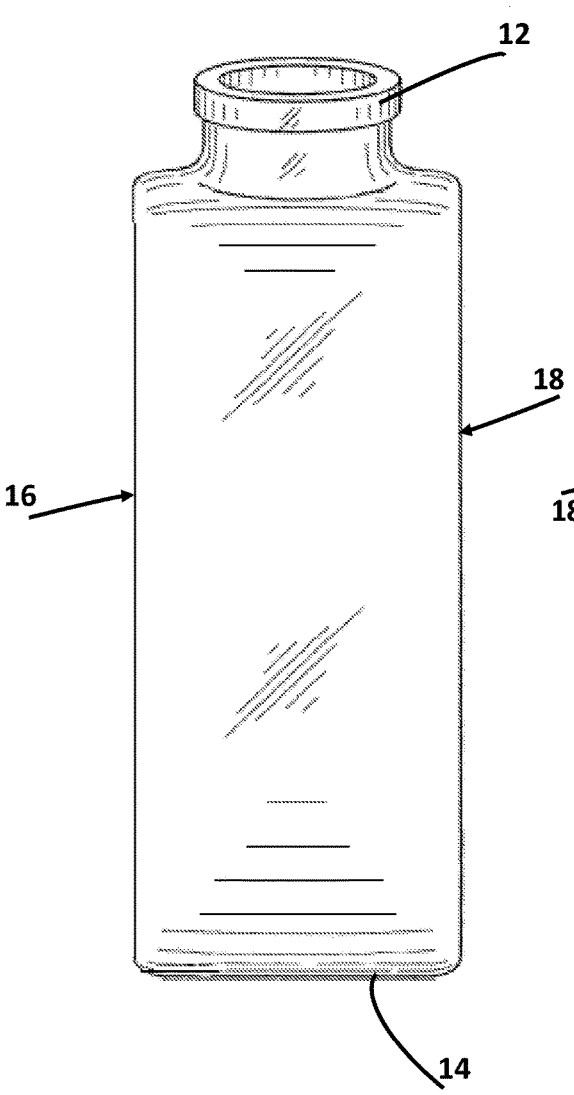
FIG. 19 is a front view of a bottle corresponding to FIG. 18.
Figure 20:
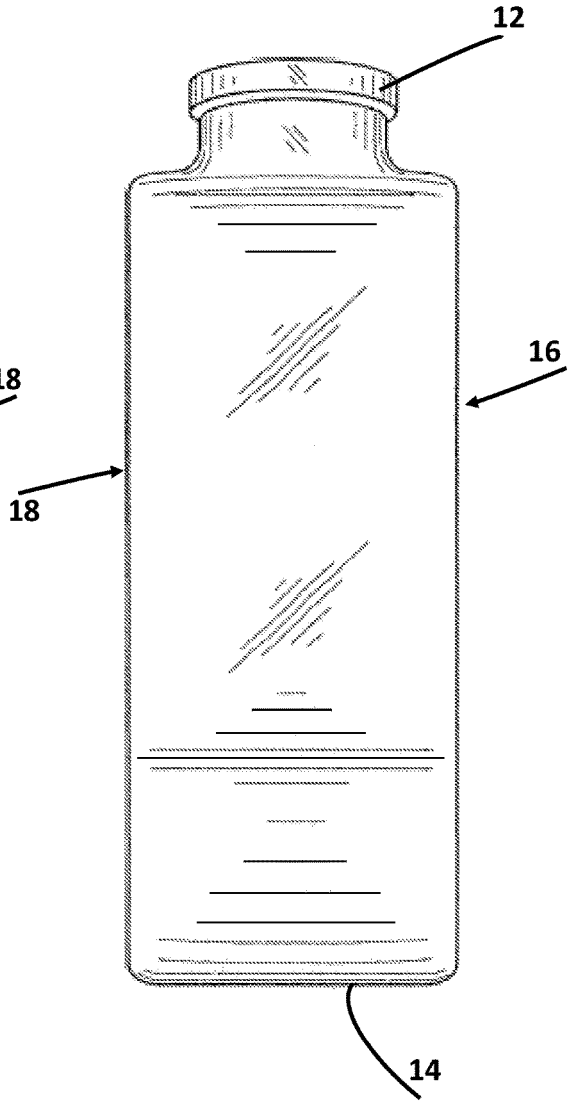
FIG. 20 is a back view of a bottle corresponding to FIG. 18.

FIGS. 18-20 are a third embodiment of a bottle according to aspects of the present disclosure. Here, the bottle is opaque rather than clear. It should be appreciated that all of the features addressed in the present disclosure can apply to any bottle without regard to the transparency of the material from which the bottle is made.

Figure 21:
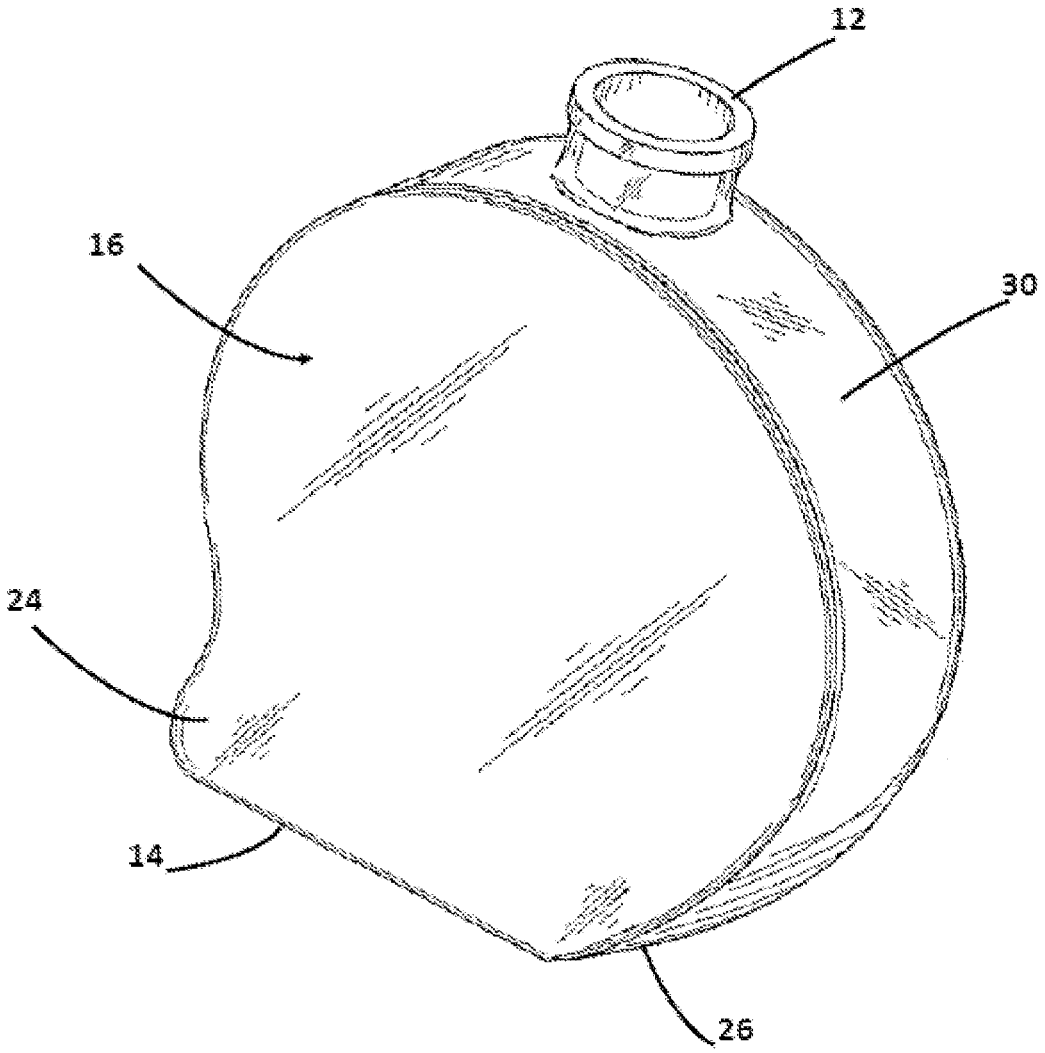
FIG. 21 is a perspective view of a fourth embodiment of a bottle according to aspects of the present disclosure.

FIG. 21 illustrates a fourth embodiment of a bottle according to aspects of the present disclosure. Here, the groove 40 and inner portion 42 illustrated in FIGS. 1-10 is eliminated. The side wall 16 is substantially flat.

It is noted that the examples shown and described are provided for purposes of illustration and are not intended to be limiting. While various embodiments of the present invention have been described in detail, it is apparent that modifications and alterations of those embodiments will occur to those skilled in the art. For example, the trailing edge 32 may have a different profile or shape. The ability of the bottle to roll on its leading edge does not directly involve the shape or contour of the trailing edge 32. Rather than being curved and providing the body with a generally cylindrical shape, the trailing edge 32 may comprise a straight portion, multiple straight portions, a differently curved portion, i.e., differently curved compared to the front portion 30, or multiple differently shaped portions. However, it is to be expressly understood that such modifications and alterations are within the scope and spirit of the present invention, as set forth in the following claims. Other modifications or uses for the present invention will also occur to those of skill in the art after reading the present disclosure. Such modifications or uses are deemed to be within the scope of the present invention.

What is claimed is:

1. A bottle, comprising:

a first side and a second side, the second side spaced from and parallel to the first side, each of the first and second sides being generally circular in shape;

a base having a toe portion and a heel portion spaced from the toe portion;

an edge connecting the first side and the second side, the edge extending from the toe portion to the heel portion;

a spout extending from the edge, the spout offset from the vertical centerline of the bottle;

the edge having a curved leading portion extending from the spout to the toe portion, and a curved trailing portion extending from the spout to the heel portion, and wherein the radius of curvature of the trailing portion of the edge is constant from the spout to the heel portion and the radius of curvature of the leading portion of the edge changes between the spout and the toe portion;

wherein, when the bottle is supported on a generally flat horizontal surface by the leading portion of the edge, the bottle will roll to a position resting on the base under the influence of the heel portion.

2. The bottle of claim 1, further comprising a channel in the first side and the second side, the channel positioned proximate the edge.

3. The bottle of claim 2, wherein the first side and the second side comprise an inner portion and an outer portion, and wherein the inner portion is inset relative to the outer portion.

4. The bottle of claim 3, wherein the inner portion has a circular shape.

5. The bottle of claim 3, wherein the channel has a substantially U-shaped cross-sectional shape.

6. The bottle of claim 1, wherein the toe portion comprises a non-linear edge.

7. The bottle of claim 1, wherein the bottle defines an interior space and the base comprises a recess extending toward the interior space.

8. A container for holding liquids, comprising:

a body having a generally circular first side and a generally circular second side spaced from the first side, a curved surface interconnecting the first and second sides, a spout extending outwardly from the curved surface, a base positioned opposite the spout between the first and second sides, the base having a toe portion and a heel portion, the body defining an interior;

the curved surface extending from the toe portion to the heel portion, wherein the portion of the curved surface extending from the spout to the heel portion is concave relative to the interior of the container, the heel portion has an outer surface that is concave, and the exterior surface of the container at the location where the curved surface joins the heel portion is convex and the location where the curved surface joins the toe portion defining a transition zone wherein the curved surface is arched between the first side and second side;

wherein the bottle is adapted to roll on the curved surface when the spout is moved from a first upright position to a second position wherein liquid may pour from the spout, wherein the bottle is adapted to return to a static position resting on the base solely under a force applied by the heel portion; and wherein when the bottle moves between the first and second positions, the bottle remains in a single vertical plane.

9. The container of claim 8, wherein the curved surface extends from the spout to the toe of the base.

10. The container of claim 8, wherein the first side has a perimeter, further comprising a channel disposed in the first side proximate the perimeter.

11. The container of claim 8, wherein the first side and the second side comprise an inner portion and an outer portion, wherein the outer portion has a flat annular surface, wherein the inner portion has a substantially flat circular surface, and wherein the inner portion is inset relative to the outer portion.

12. The container of claim 11, wherein the inner portion has a circular shape.

13. The container of claim 12, further comprising a channel disposed between the inner and outer portions, and wherein the channel has a substantially U-shaped cross-sectional shape.

14. The container of claim 13, wherein the body defines an interior space, and wherein the channel has a bottom surface that extends into the interior space farther than the inner portion of the first and second sides.

15. The container of claim 8, wherein the container has a vertical centerline and the heel portion is offset from the vertical centerline.

16. A bottle comprising:

a first side wall and a second side wall spaced from the first side wall;

a base interconnecting a portion of the first side wall and second side wall, the base having a toe portion and a heel portion spaced from the toe portion;

an edge surface interconnecting the first side wall and the second side wall and extending from the toe portion to the heel portion of the base, the edge surface curved from the toe portion to the heal portion;

a spout extending outwardly from the edge surface;

wherein, at the location where the edge surface joins the heel portion the edge surface is convex, and at the location where the edge surface joins the toe portion the edge surface is concave, and wherein the bottle has a vertical centerline extending between the base and the spout and the base and the edge surface are asymmetrical relative to the centerline.

17. The bottle of claim 16, wherein the edge surface comprises a curved leading portion that extends from the toe portion to the spout.

18. The bottle of claim 16, wherein the spout extends from the edge surface at an acute angle.

19. The bottle of claim 16, wherein the spout is offset from the centerline of the bottle.

20. The bottle of claim 16, wherein the edge surface comprises a curve trailing portion that extends from the heel portion to the spout.

21. The bottle of claim 16, wherein the perimeter shape of the first side wall and the second side wall is substantially circular.

* * * * *